United States Patent [19]

Newton

[11] 3,989,104

[45] Nov. 2, 1976

[54] CONDENSER INSERTS

[75] Inventor: Alwin B. Newton, York, Pa.

[73] Assignee: Borg-Warner Corporation, Chicago, Ill.

[22] Filed: July 13, 1972

[21] Appl. No.: 271,442

[52] U.S. Cl. ..... 165/111; 62/285; 138/38; 165/DIG. 18

[51] Int. Cl.[2] ..... F28B 9/08

[58] Field of Search..... 165/110, DIG. 18, 111, 165/174, 179; 138/38; 62/285

[56] References Cited

UNITED STATES PATENTS

| | | | |
|---|---|---|---|
| 496,757 | 5/1893 | Theisen | 165/110 |
| 2,970,669 | 2/1961 | Bergson | 165/11 |
| 3,468,345 | 9/1969 | Tam et al. | 138/38 |

FOREIGN PATENTS OR APPLICATIONS

| | | | |
|---|---|---|---|
| 4,769 | 8/1965 | Germany | 165/110 |
| 732,389 | 6/1955 | United Kingdom | 165/110 |

*Primary Examiner*—Albert W. Davis, Jr.
*Attorney, Agent, or Firm*—Thomas B. Hunter

[57] ABSTRACT

An improved insert for a vertical tube condenser comprising a trunk having a plurality of upward extending branches of different lengths formed to have a dense uniform pattern of pick-off points over the tube surface so as to effectively pick-off, by capillary action, the great part of the condensate and to maintain a relatively thin average thickness of condensate on the surface.

3 Claims, 7 Drawing Figures

CONDENSER INSERTS

FIELD OF THE INVENTION

The present invention relates to improved inserts for condensation tubes of condensers and especially for vertical condenser tubes used in refrigeration equipment.

CROSS-REFERENCE TO RELATED APPLICATION

The present invention is an improvement over the inserts disclosed and claimed in co-pending U.S. patent application Ser. No. 71,539 entitled IMPROVEMENTS IN VERTICAL SURFACE VAPOR CONDENSERS which application was filed by Alwin B. Newton, the present inventor, on Sept. 11, 1970 and is assigned to the same assignee as is the present invention.

BACKGROUND OF THE INVENTION

The general background of this invention is outlined in the aforementioned Newton application.

SUMMARY OF THE PRESENT INVENTION

The present invention is founded upon the discovery that a dense more or less even pattern of points for picking off the condensate results in a lower surface thickness and improved performance of the condenser. In accordance with the present invention an insert for a condensing tube includes a plurality of different length branches extending upward from a trunk member to the condensing surface to form such a contact array and pick-off by capillary action the condensate, guide it down the branches to keep the average thickness of condensate on the condensing surface small and to thereby improve the efficiency of the condenser.

The features of the present invention which are believed to be novel are set forth with particularity in the appended claims. The invention, together with the further advantages thereof, may best be understood by reference to the following description taken in connection with the accompanying drawings, in the several figures of which like reference numerals identify like elements.

DETAILED DESCRIPTION

Figure 1:
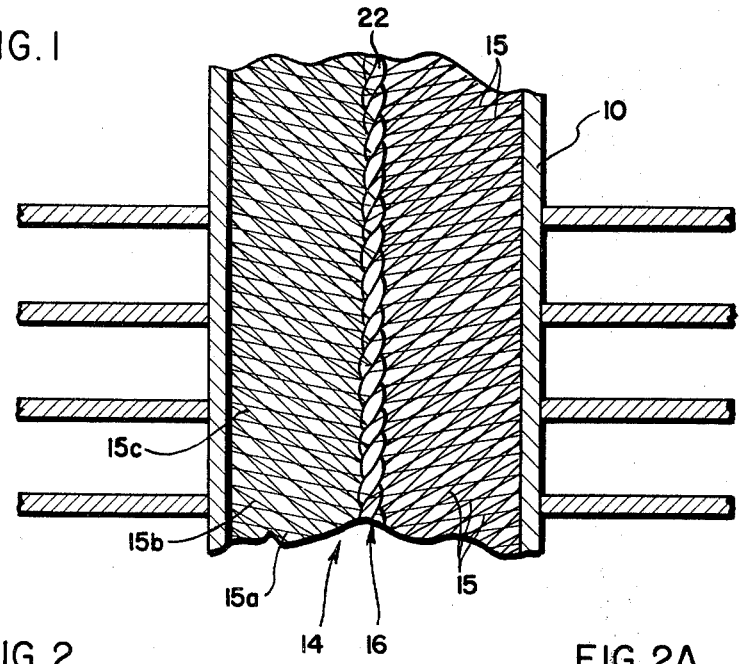
FIG. 1 is a cross sectional view of a condenser tube and insert constructed in accordance with the present invention.
Figure 2:
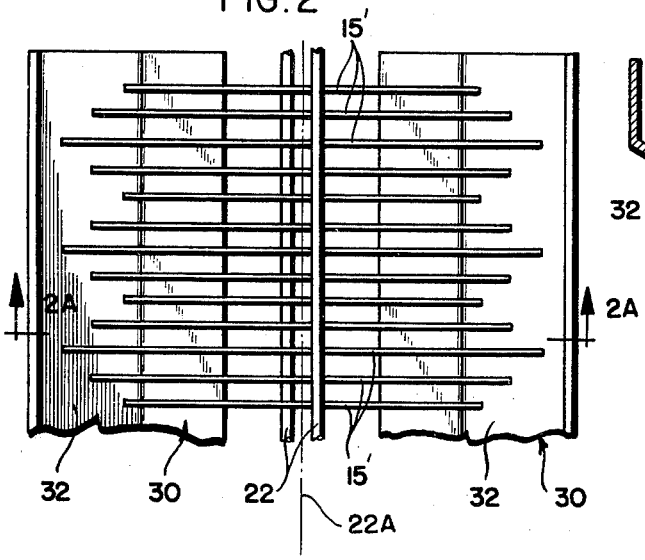
FIG. 2 is a partial plan view of a layout table useful in practicing and illustrating the method of making the insert of FIG. 1.

The general description of a condenser and refrigeration system is detailed in the aforementioned Newton application and the portion of that application dealing with its FIGS. 1 and 2 embodiment is hereby incorporated by reference in accordance with the practice authorized by the Commissioner of Patents in the notice published in 34 Federal Register 833 (859 Official Gazette 346).

In FIG. 1 hereof, 10 is a vertical condenser tube having an interior condensing surface 12 and, in accordance with the present invention an insert, generally 14. The tube 10 has an inlet (not shown) at its top for receiving gas and an outlet at its bottom from which liquid is removed. The insert 14 has a large number of branches or bristle-like members 15 which are of varying lengths and extend at different angles from a trunk 16 at the center of the tube 10. The trunk 16 is made up of two wires 22. The branches 15 strike the surface 12 at many points nearly equal in spacing in all directions, including the spacing between the spirals inherent in brush construction. Use of varying lengths is shown especially at bristle 15*a* (short), 15*c* (long) and 15*b* (intermediate length). Different deflections occur to provide the contact at intermediate levels.

Inserts of this general type may be formed in the same manner of brushes by using a pair of relatively thick wire members, traversally laying a number of branch members between them and then twisting the wires together to captivate and distribute the branch members. If, however, equal length units of wire are used for the branches and they are aligned in side by side arrangement with their ends paralleling the wires there results a spiral alignment of their end points. When inserted as taught in the aforementioned patent application, this results in the pick-off points of adjacent wires or bristles being spaced closely adjacent to each other but separated by a relatively large distance from the points directly above or below. This uneven distribution of the pick-off points is overcome by the present improvement.

Each end of the wire or bristle-like member serves as a pick-off point for, by capillary action, stripping of condensate a generally circular field about it. The size of the effective area depends upon the condensate used and other properties of the condensers which effect the liquid surface tension at the surface 12. The spacing between pick-off points may thus vary from system to system, but the range of ¼ to ⅛ inch between pick-off points has been found to yield good results for most systems.

Figure 2A:
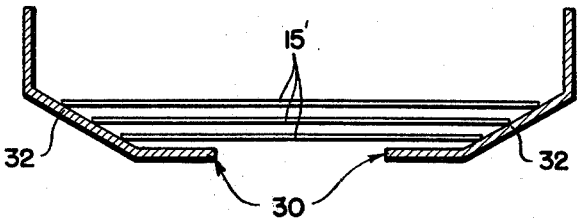
FIG. 2A is a sectional view of the table of FIG. 2.
Figure 3:
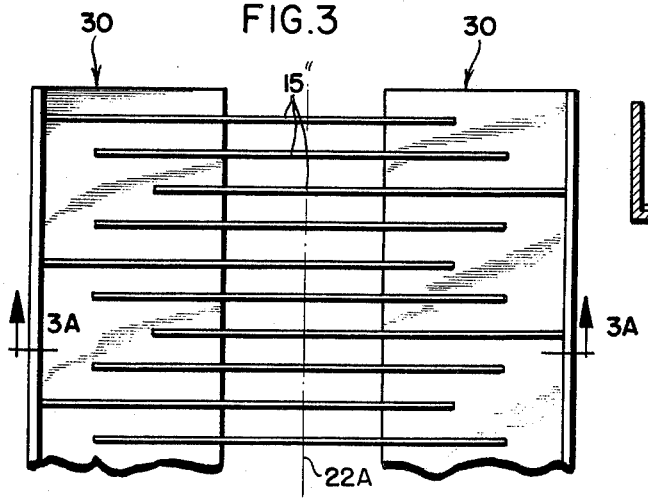
FIG. 3 is a partial plan view of an alternative layout table useful in practicing and illustrating another method of making the insert of FIG. 1.
Figure 3A:
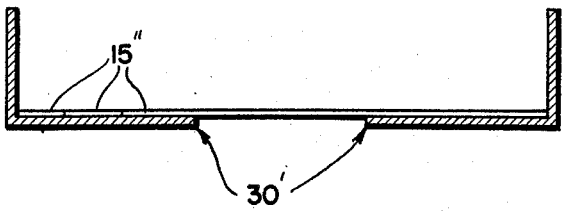
FIG. 3A is a sectional view of the table of FIG. 3.

Referring to FIG. 2, there is illustrated one way of making the insert 14. In this case the elements 15′, which are formed into the branches 15 are of unequal length, the assembly table 30 has two edge boards 32 which slant inward (as shown in FIG. 2A) to allow for receiving of the elements 15′ along an axis 22A. The differing length elements are distributed along the table so as to have approximately the same density of each type therealong. In FIG. 3 equal length elements 15″ are distributed cyclonically longitudinally displaced on a flat surface (as shown in FIG. 2A) from the axis 22A. In either case one of the two trench forming members or wires 22 is placed above and the other below the elements 15′ or 15″, along the axis 22A, brought into close contact therewith to captivate the elements and then twisted to form the insert 14.

The basic phenomenon, by virtue of which this system functions, includes the surface tension effect of the liquid condensate at the point where the bristle touches the tube wall. Other factors are involved but, in general, the heat transfer coefficient is increased as the bristles touch in a closer pattern until the thickening of the film at the bristle caused by capillarity begins to interfere with the thickening of that of an adjacent bristle. Thus, there is an optimum range of spacing for any particular case, and the optimum spacing is influenced by the surface tension of the liquid being condensed. This phenomenon is illustrated in FIG. 3. The variation of the heat transfer coefficient (in BTU per hour per degree fahrenheit per square foot of tube surface) is compared with the average spacing S in inches for condensates of higher (A) and lower (B) surface tension.

Figure 4:
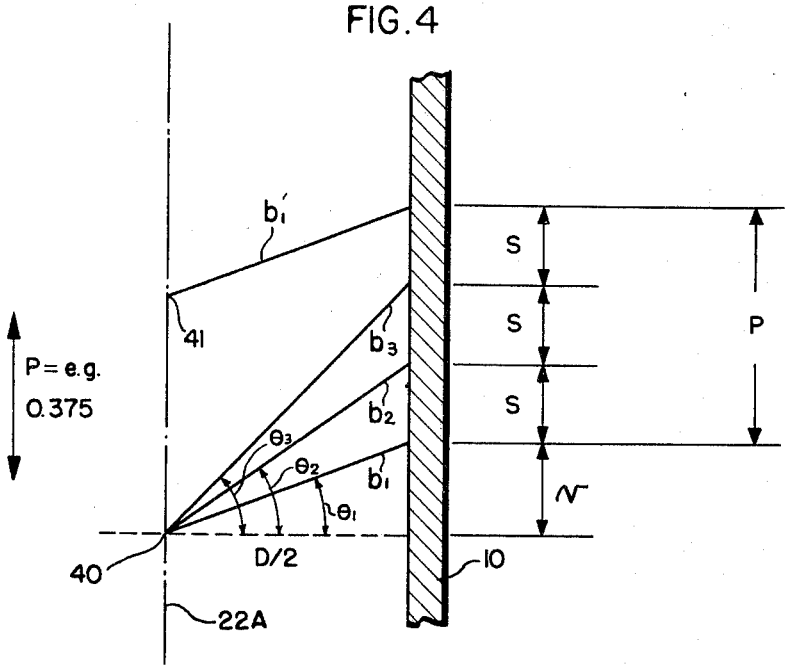
FIG. 4 is a view similar to that of FIG. 1 showing only representative, branch or bristle-like members and which Figure is useful in explaining the theory and giving examples of the present invention.
Figure 5:
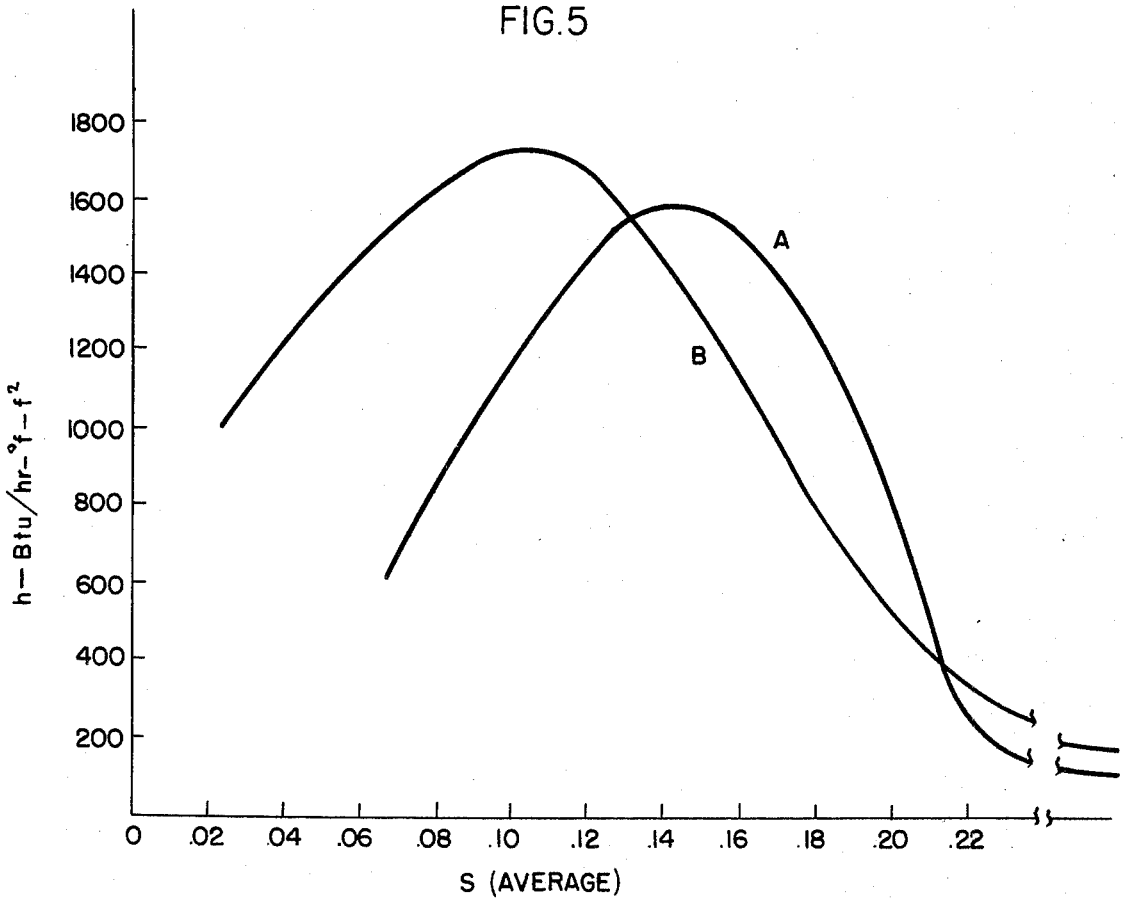
FIG. 5 is a graphical representation of typical relationships useful in illustrating the method.

For a tube, such as that illustrated in FIG. 4, with a diameter D, a uniform spacing S the number of pick-off points (and for non-forking bristles or branches such as herein illustrated the number of branches needed) is given by the formula:

$$N = \frac{l\pi D}{S^2} \tag{1}$$

wherein $l$ is the length of the tube. The number needed per unit of length is, of course:

$$\frac{N}{l} = \frac{\pi D}{S^2} \tag{2}$$

Should it be decided, in optimizing, to use separate vertical and horizontal separation S′ and $s$ respectively between the pick-off points, this equation becomes:

$$\frac{N}{l} = \frac{\pi D}{S's} \tag{3}$$

A specific case of equal spacing and of a pitch $P=3S$ using non-forking branches is illustrated in FIG. 4. In this case the three different lengths of branches $b_1$, $b_2$ and $b_3$ are given by the equations:

$$b_1 = \frac{D}{2 \cos \phi^1} \tag{4}$$

$$b_2 = \frac{D}{2 \cos \phi_2} \tag{5}$$

$$b_3 = \frac{D}{2 \cos \phi_3} \tag{6}$$

Of course, once $\phi_1$ is chosen the remainder of the relationship and lengths can be determined in a number of ways. For example defining $v_1$ as the vertical distance from the diameter line D/2 to the point of $b_1$ (see FIG. 4) it follows that $\phi_2$ can be determined from the relationships:

$$\cot \phi_2 = \frac{D}{2\,(v_1 + S)} \tag{7}$$

and $$v = b_1 \sin \phi_1 \tag{8}$$

These combine to yield:

$$\phi_2 = \text{arc cot}\left[\frac{D}{2\,b_1 \sin \phi_1 + 2s}\right] \tag{9}$$

Similarly $\phi_3$ could be found by the formula:

$$\phi_3 = \text{arc cot}\,\frac{D}{2\,(2_s + b_1 \sin \phi_1)} \tag{10}$$

As one specific case, assume $s = ⅛$ inch $= 0.125$ inch, $P = 3s = 0.375$ inch, $D = 0.71$ inch and $\phi = 20°$. From equation (4)

$$b_1 = \frac{0.71 \text{ inch}}{2\,(0.939)} = 0.368 \text{ inch}$$

From equation (9):

$$\phi_2 = \text{arc cot}\,\frac{0.71 \text{ inch}}{2\,(0.368 \text{ inch})(0.342) + 2\,(0.125 \text{ inch})}$$

$$= \text{arc cot } 1.41 = 35°20'$$

Thus from equation (5):

$$b_2 = \frac{0.71 \text{ inch}}{2 \cos 35°\,20'}$$

$$b_2 = 0.435 \text{ inch}$$

From equation (10):

$$\phi_3 = \text{arc cot } 0.941 = 46°15'$$

And from equation (6)

$$b_3 = \frac{0.71 \text{ inch}}{2 \cos 46°\,15'}$$

$$b_3 = 0.515 \text{ inch}$$

In this example, for the FIG. 2 method, the bristle lengths would be 0.736 inch, 0.870 inch and 1.03 inch.

When assembled, the angle of the shorter bristle will be 20° to the horizontal and each successive bristle will strike the circumference at an increment of ⅛ inch higher than the shorter bristles to provide an overall ⅛ inch square pattern of bristle impringement on the circumference. Similar calculations can be made for any other required spacing and pitch.

If the assembly is to be made according to FIG. 3, all bristles will be of uniform length, 0.870 inches. Bristles for the medium level will be placed to extend equally from the center wires. Adjacent bristles will extend 0.368 inches on one side of the center and 0.515 inches on the other side of the center in alternate directions. The error introduced by this method of assembly is less than 0.01 inch in bristle length and is considered acceptable for most applications.

Although here sometimes termed "wire" the bristle-like branch members 15 may be made of metal, nylon or plastic or any other material as long as the pick-up point has a positive capillary attraction for the condensate. They could also be forked or split to increase the number of pick-up points per branch.

While a particular embodiment of the invention has been shown or described, it will be obvious to those skilled in the art that changes and modifications may be made without departing from the invention in its broader aspects. It is therefore the intent of the following claims to cover every form that the invention may assume including improved forms which may merit patents of their own, and those forms that differ in appearance from the form herein described. The following claims which are dependent in form should be construed to include the limitations of the claim from which they depend and each claim (whether in independent or dependent form) should be constructed independently of the other claims. The validity of each claim should also be considered independently of the other claims. These claims, when issued, should be presumed valid and should be interpreted and applied liberal and as broadly as permitted by the prior art and construed narrowly only if necessary to save them from invalidity.

I claim:

1. In combination with a vertical condensing tube of the type where condensate is formed on the interior surface of the tube, the improved insert comprising:

a trunk member, and a plurality of bristle-like branches attached to the trunk and having differing effective lengths so as to contact the interior surface of the tube in a dense essentially uniform array of pick-up points.

2. The combination defined as in claim 1, wherein said trunk member is formed of at least two elongated members twisted together; and wherein a large number of bristle elements are captivated between said twisted members, said bristle elements extending over a range of different lengths so as to contact the interior surface of the tube in an essentially uniform array of pick-up points when assembled into the interior of the tube.

3. The combination of claim 2 wherein the spacing between pick-off points is between ⅛ and ¼ inch over the surface.

* * * * *